United States Patent [19]

Mackey

[11] Patent Number: 4,521,923

[45] Date of Patent: Jun. 11, 1985

[54] NAME BELT WITH SELECTIVE LETTER INSERTS

[76] Inventor: Charles P. Mackey, P.O. Box 847, Chickasha, Okla. 73018

[21] Appl. No.: 561,041

[22] Filed: Dec. 13, 1983

[51] Int. Cl.[3] ..... A41F 9/00

[52] U.S. Cl. ..... 2/338; 2/339; 40/595; 40/618; D2/392

[58] Field of Search ..... 2/338, 339; 40/595, 40/596, 535, 536, 618; D2/392, 393, 394, 380

[56] References Cited

U.S. PATENT DOCUMENTS

| | | | |
|---|---|---|---|
| 1,430,682 | 10/1922 | Pollak | 40/618 |
| 2,447,011 | 8/1948 | Hayes | 40/595 |
| 2,875,540 | 3/1959 | Walters | 40/618 |
| 3,229,398 | 1/1966 | Kopatich | 40/618 |
| 3,358,398 | 12/1967 | Chalfin | 40/596 |
| 4,340,976 | 7/1982 | Wright | 2/338 |

*Primary Examiner*—Werner H. Schroeder
*Assistant Examiner*—Mary A. Ellis
*Attorney, Agent, or Firm*—Glaser, Griggs & Schwartz

[57] ABSTRACT

A decorative name belt includes laminated layers of belt material between which is disposed an elongated support member having opposed flanges with spaced apart slots formed therein for receiving decorative indicia members such as monogram letters or the like for assembling a personalized name or monogram belt. The outer belt lamina or layer is provided with a recess along the major extent of the support member which permits insertion of and removal of premolded indicia or letter members into the cooperating slots in the support member so that a selected name or monogram combination may be provided on the belt. Each of the letters includes opposed support projections or bosses on one side and a key member or members integrally formed with the letter member on the opposite side for supporting the respective letter members at spaced apart intervals in the recess. The keys are integrally formed with the respective letter members and are connected thereto by a flexible hinge portion. Locking surfaces on the key members are engageable with cooperating surfaces on the support member to prevent unwanted removal of the letter members from the support member. The support member may be used as part of a nameplate or sign also.

17 Claims, 11 Drawing Figures

FIG. 7
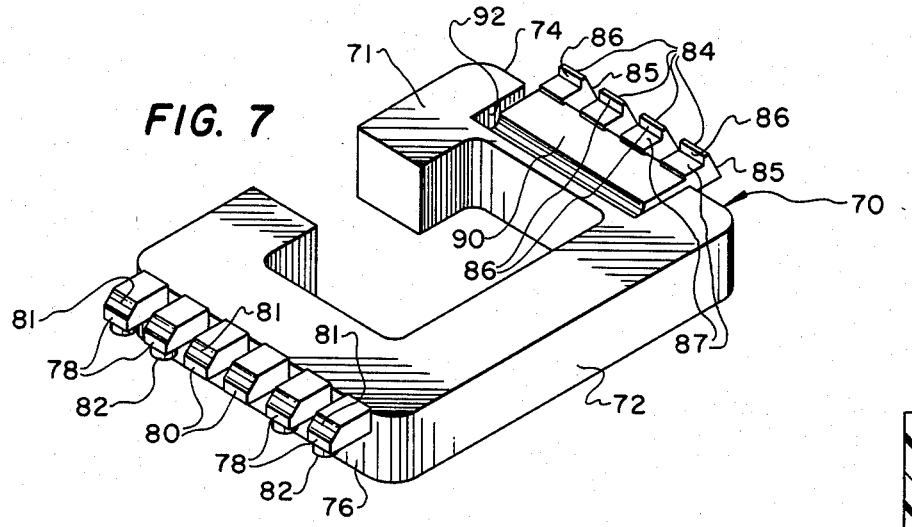
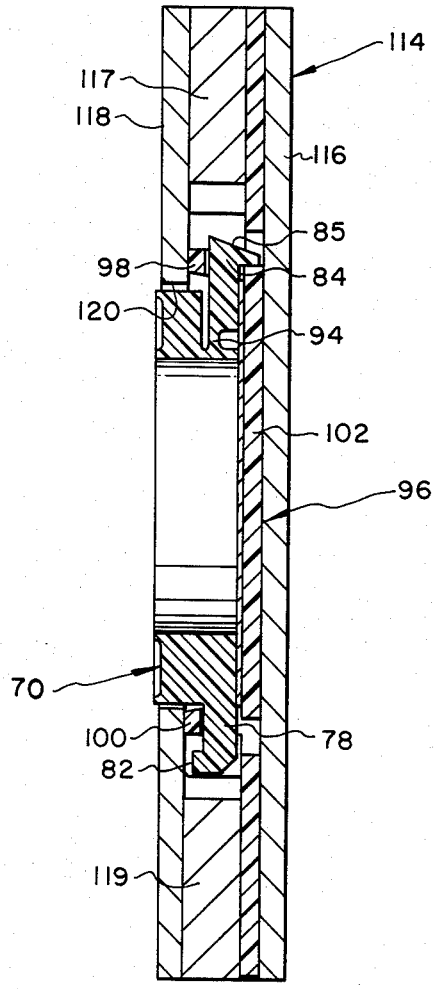
FIG. 9
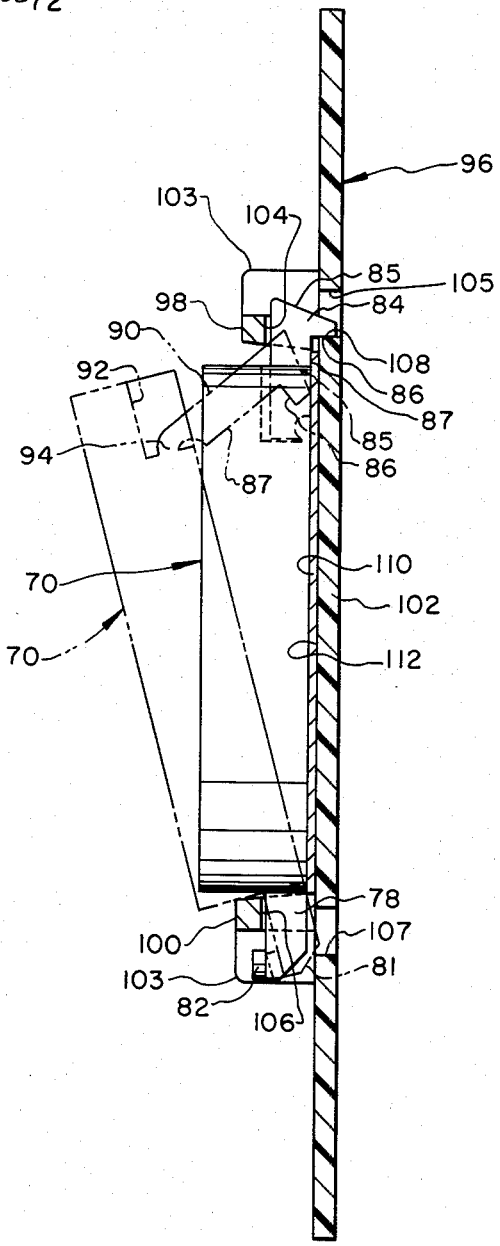
FIG. 8

NAME BELT WITH SELECTIVE LETTER INSERTS

BACKGROUND OF THE INVENTION

1. Field of the Invention

The present invention pertains to a belt to be worn with trousers or the like and having a portion provided with a support for mounting selective letter inserts on the belt for personalizing the belt with a monogram or name.

2. Background

In men's and women's furnishings, western style "name" belts made of leather or other flexible material have become very popular. These belts are typically provided with a decorative design and across the midsection of the belt the owner's given name, monogram or other indicia is often provided in an artistic manner such as by engraving coining, or branding the leather or other belt material. The engraving and coining processes are particularly time consuming, expensive and are permanent. However, in order to appeal to the casual purchaser or someone wishing to change the name or other indicia on the belt from time to time, it is highly desirable to be able to provide a name or monogram belt wherein the indicia may be easily selected and applied to the belt at the time of purchase without waiting for the engraving or other indicia application process. Moreover, it is also desirable to be able to interchange the lettering or other indicia, at will, to provide a belt suitable for various occasions or events. These desiderata have been met with the name belt of the present invention.

SUMMARY OF THE INVENTION

The present invention provides an improved man's or woman's furnishing in the way of a decorative belt to be worn about the waist and having a unique mounting arrangement for selective placement of name or monogram letters or other indicia in a portion of the belt such as across the back or midsection thereof.

In accordance with one aspect of the present invention there is provided an improved so called western style name belt having a recess formed across the midsection of the belt normally placed along the wearer's backside, which recess has a support member for receiving and supporting a plurality of separate letters or similar indicia in the recess in a predetermined sequence to provide a monogram, a name or to provide some other ornamental feature.

In accordance with another aspect of the present invention there is provided a belt having an elongated support member adapted for receiving and retaining a plurality of separate letters or other indicia which may be spaced apart in a desired pattern and may be interchanged at will in the event of misspelling or when it is desired to provide a different decoration on the belt. The support member is preferably formed as an elongated planar member having opposed longitudinally extending flanges which are provided with a plurality of spaced apart recesses or slots for receiving and supporting one or more letters at selected spaced apart intervals.

In accordance with still a further aspect of the present invention there is provided a name belt or the like having a support member for a plurality of letters or similar indicia which are adapted to be received by and interlocked with the support member to retain the letters in a fixed position but also permitting removal and interchanging of the letters, if desired. The letters are preferably cast or otherwise formed of a material which has the appearance of the belt material and each of the letters is provided with opposed projections which are engageable with recesses or slots formed in opposed flanges of the letter support member whereby the letters may be selectively spaced in the belt recess and wherein the projections extending along at least one side of the letters are formed with locking surfaces which are cooperable with the support member to prevent casual or unwanted removal of the letters from the belt. The support and locking projections on the letters or similar indicia elements are of a unique configuration and are connected to the body of the letters by an integrally formed hinge portion which permits relative movement between the body of the letter and the projections for insertion in and removal of the letter with respect to the support member.

In accordance with still a further aspect of the present invention there is provided a decorative name belt or the like wherein a preselected decorative panel may be provided as a background or field for the decorative letters or other insertable indicia, which panel is supported on and covers a web portion of the letter support member.

The present invention still further provides an improved decorative name belt formed in a manner in which a plurality of layers of material are used to construct the belt and to form a recess for receiving a support member for a plurality of letters or other indicia and for receiving the letters themselves.

Although the present invention is particularly adapted for and useful as a decorative name belt, in accordance with certain aspects of the invention the decorative letters and the cooperating support member are adapted for use with other structure, as required, to form a sign, nameplate, or similar article enjoying all of the superior features of the invention.

Those skilled in the art will further appreciate the abovedescribed features and advantages of the present invention as well as other superior aspects thereof upon reading the detailed description which follows in conjunction with the drawing.

BRIEF DESCRIPTION OF THE DRAWING

FIG. 7 is a perspective view of another embodiment of a letter member for use with a cooperating letter support member;

FIG. 8 is a transverse vertical section view of a letter support member in assembly with a letter member having the configuration of the letter of FIG. 7;

FIG. 9 is a vertical transverse section view of a name belt havng a letter support member and letter of the configuration illustrated in FIG. 7;

DESCRIPTION OF THE PREFERRED EMBODIMENTS

Figure 1:
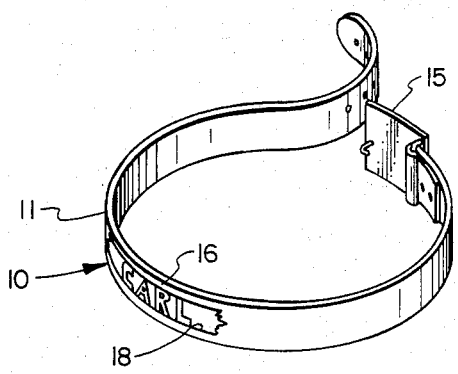
FIG. 1 is a perspective view of the name belt of the present invention.
Figure 2:
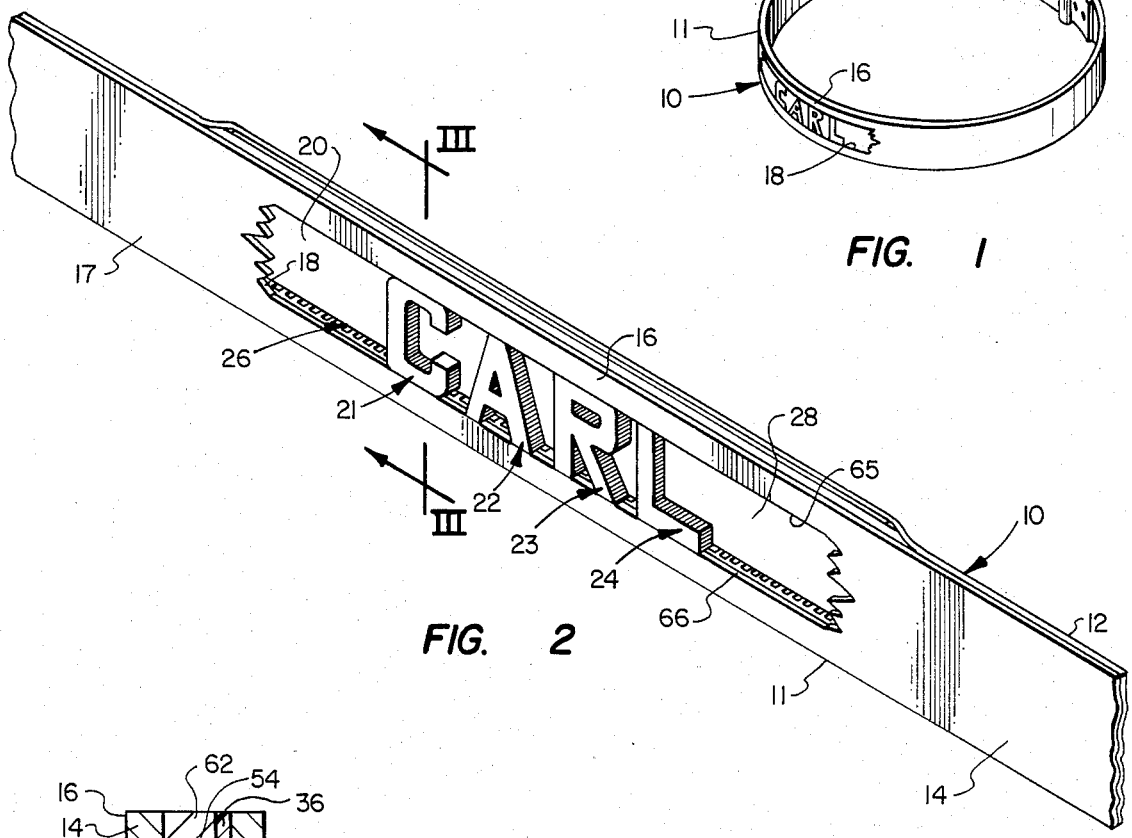
FIG. 2 is a perspective view of a portion of the belt of FIG. 1 showing a recess for receiving an arrangement of letters or other indicia to provide a monogram, proper name or other decorative design.

Referring to FIGS. 1 and 2, there is illustrated a unique man's or woman's furnishing in the form of a belt to be worn with slacks or jeans and which belt is generally designated by the numeral 10. The belt 10 is typically of the so called western style and includes a member 11 formed of laminae or layers 12 and 14, FIG. 2, of leather or a leatherlike material. The belt 10 includes a buckle or hasp 15, FIG. 1, for securing it in place on the wearer's body. The belt 10 is of a type which is also adapted to be personalized by providing monogram lettering or the owner's name or other indicia across the midsection 16 of the backside of the belt when worn in a normal wearing position.

In accordance with the present invention, the outer lamina 14 is provided with an outer surface 17 having an elongated opening 18 defining in part a recess 20 in which unique indicia in the form of uniquely constructed letter members 21, 22, 23 and 24 are mounted to spell out a person's name or other desired word or identifier. The letters 21 through 24 are exemplary and those skilled in the art will appreciate that various indicia, such as any of the letters of the alphabet, Arabic numerals, as well as members depicting various ornamentation may be used in place of the exemplary letters shown while utilizing the unique features and aspects of the present invention.

Figure 3:
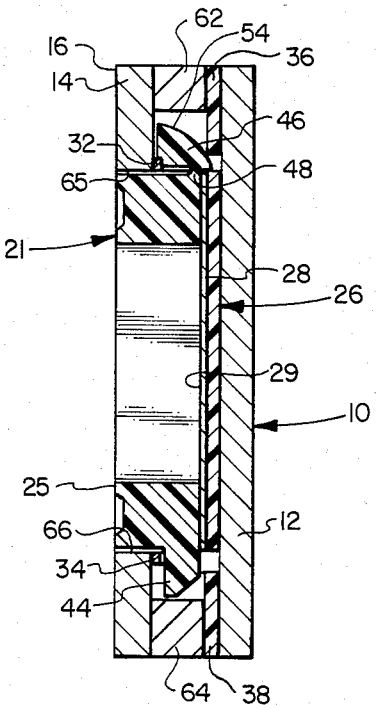
FIG. 3 is a section view taken along the line III—III of FIG. 2.

The letters 21 through 24 are adapted to be removably mounted in the recess 20 and supported therein by an elongated support member, generally designated by the numeral 26 in FIGS. 2 and 3, for example. The member 26 may be formed of injection molded plastic or the like in various colors and, if desired, the member 26 may be provided with a backing or field member 28 which is suitably bonded to the member 26 and forms a field or background for the indicia members 21 through 24. The field member 28 may be a piece of fabric having a suitable adhesive layer formed thereon which may be bonded to the surface 29 of the member 26 to provide an aesthetically appealing background for the indicia members 21 through 24.

Figure 5:
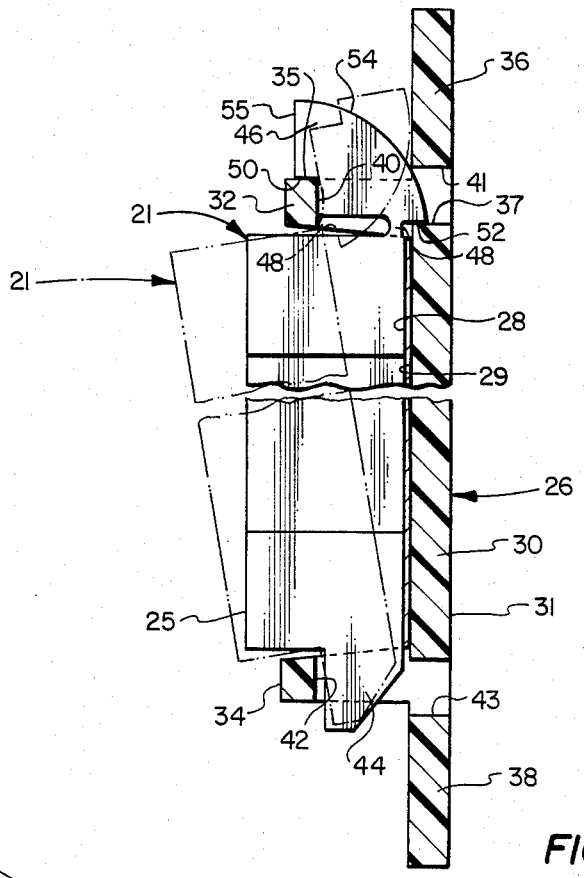
FIG. 5 is a detail section view of the letter support member on a larger scale and showing a letter member inserted in the support member.
Figure 6:
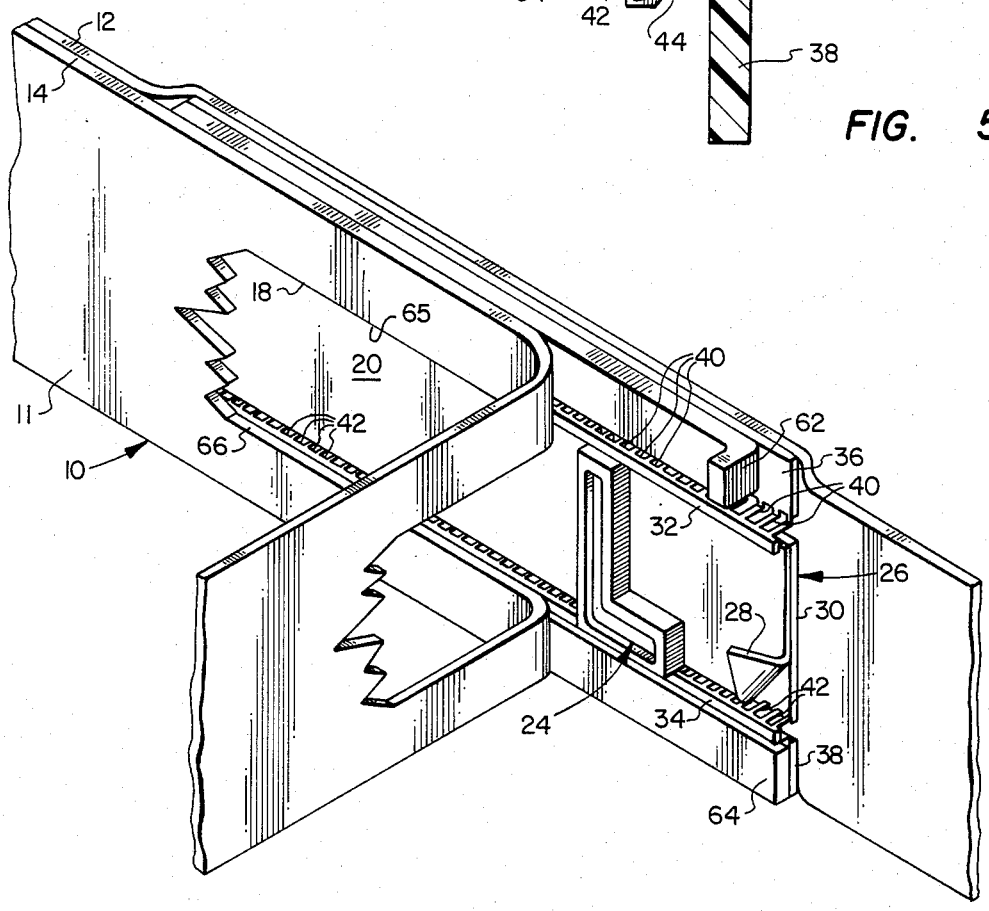
FIG. 6 is a perspective view showing portions of the belt structure in the vicinity of the letter receiving recess pulled away to illustrate the structural features.

Referring to FIGS. 5 and 6, the indicia support member 26 includes an elongated planar web portion 30 forming the support surface 29 and which is interposed between opposed parallel flanges 32 and 34. Integral extensions of the web portion 30 extend from opposite sides of the respective flanges 32 and 34 as indicated at 36 and 38. The flanges 32 and 34 are provided with a plurality of spaced apart keyways or slots 40 and 42, respectively, which are aligned with each other on the flanges and include slot portions 41 and 43 in the web portion 30, FIG. 5, and which open to the surfaces 29 and 31 of the member 26. The slots 40 and 42 are characterized as openings which project through the flanges 32 and 34 and are of a rectangular shape in a plane perpendicular to the plane of the surfaces 29 or 31. Each slot 40 is aligned with a corresponding slot 42 along the respective flanges 32 and 34. The slot portions 41 and 43 are rectangular shaped and are each aligned with a respective one of the slots 40 and 42, respectively.

Figure 4:
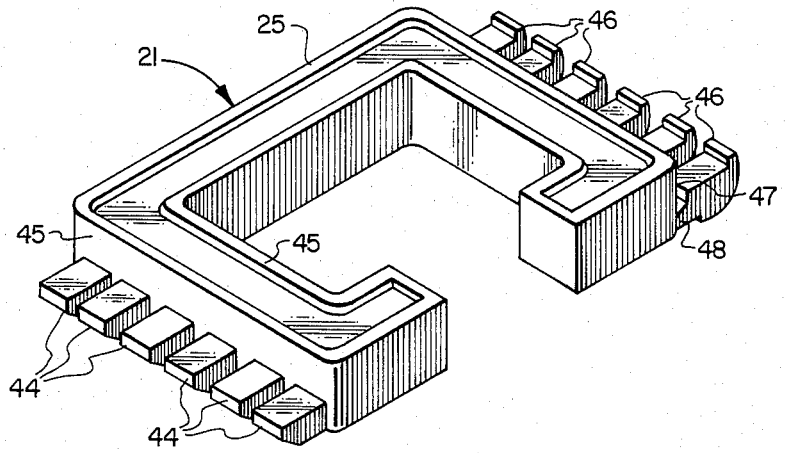
FIG. 4 is a perspective view of one of the letter members for use with the belt illustrated in FIGS. 1 and 2.

Referring now to FIGS. 4 and 5, in particular, the indicia member or letter 21 is shown by way of example as having a body 25 provided with a plurality of spaced apart projections or bosses 44 extending parallel to each other and along the bottom side edge 45 of the letter body itself. The projections 44 are characterized as substatially rectangular bosses dimensioned to fit within the slots 42 and having a spacing corresponding substantially to the spacing of the slots 42. The opposite side edge 47 of the letter member body 25 is also provided with a plurality of spaced apart projections or keys 46 which are also dimensioned to fit in the slots 40 and are spaced apart from each other the same distance as the spacing of the slots 40 or 42. The keys 46 are of a unique configuration and are hinged to the side edge 47 of the member 21 by an integral hinge portion 48, see FIG. 5 in particular. The keys 46 are also provided with two spaced apart locking surfaces 50 and 52 which are cooperable with surfaces 35 and 37 on the flange 32 and in the slot portion 41, respectively, to prevent unwanted removal of the letter member 21 from its mounted position between the flanges 32 and 34, as shown in FIGS. 3 and 5. The keys 46 each also include a sloping cam surface 54, FIG. 5, extending from an edge delimiting the surface 52 to a surface 55 perpendicular to the surface 50. When the keys 46 are inserted in the slots 40, the rearwardly projecting portion of the key 46 formed between the ledge or surface 52 and the cam surface 54 projects into the recess portion 41 and the surface 52 is engageable with the surface 37, as shown in FIG. 5 in the position of the key 46 indicated by the solid lines. In the position of the key 46 indicated by the solid lines in FIG. 5, the surface 50 is interlocked with the flange 32 to prevent unwanted removal of the member 21 from its mounted position between the flanges 32 and 34. The total number of projections 44 and 46 are determined by the shape of the letter member and the surface area available for providing the projections. At least one of each of projections 44 and 46 are normally provided.

When it is desired to insert an indicia member such as the letter member 21 into the support member 26, the member 21 is positioned such that the key or keys 46 project into respective ones of the slots 40 in the position indicated by the dashed lines in FIG. 5. In this position, the member 21 may then be bent with respect to the key 46 about the integral hinge portion 48 sufficiently such that the projections or bosses 44 may be inserted into corresponding ones of the slots 42. The key 46 is operable to engage the edge of the slot 40 to prevent unwanted removal of the key from the slot as the member 21 is first rotated counterclockwise, viewing FIG. 5, with respect to the key 46 to insert the bosses 44 in their corresponding slots 42. The member 21 is then forcibly moved toward the surface 29 whereupon the cam surface 54, bearing against the surface 29 will permit the key 46 to be rotated about the hinge 48 and relative to the body 25 into the locking position shown by the solid lines in FIG. 5 whereupon the surfaces 50 and 52 will engage the respective cooperable surfaces 35 and 37. The member 21 is now securely locked in position to form a substantially permanent indicia for the belt 10, if desired.

However, if it is desired to interchange the letters or other indicia members inserted in the recess 20, it is possible to remove the letter members by pulling the member 21, for example, in essentially the reverse direction of the movement that resulted in insertion of the member into mounted position. By pulling outward on the top edge 47 of the member body 25 away from surface 29, for example, the body will rotate outward away from surface 29 and, if the member 21 is pulled forcibly, the portions of the flange 32 defining the slots 40 will deform sufficiently to permit the surfaces 52 to clear the cooperating surfaces 37 so that the keys 46 may be removed from slots 40 and the member 21 may be unlocked and removed from the belt. Clearly, this removal process must be carried out at will since the members 21 through 24 are securely locked in position once they are inserted into the slots 40 and 42 in the support member 26 and give the appearance of being permanently mounted in the recess 20. Accordingly, if it is desired to change the indicia mounted on the belt 10 or if a mistake is made in selecting a letter member, the letters may be changed or moved. This configuration also provides versatility in the selection process by the customer at the time of purchase and no delay in completing the purchase is necessary.

The construction of the belt 10 is also advantageous in that, as previously described, the belt is preferably made of two members or laminae 12 and 14 secured together to form the belt. In the vicinity of the support member 26, elongated filler strips 62 and 64, FIGS. 3 and 6, are sandwiched between the respective web portions 36 and 38 and the outer lamina 14. In the fabrication of the belt 10, the support member 26 is secured to the inner belt lamina 12 by a suitable adhesive or the like, not shown, and the filler strips 62 and 64 are then laminated to the web portions 36 and 38 of the support member 26. Lastly, the outer belt lamina 14 is bonded to the inner belt lamina 12 and to the filler strips 62 and 64. As shown in FIG. 2, in particular, the opposite longitudinal side edges 65 and 66 of the recess 20, as defined in part by the opening 18 in the belt lamina 14, are disposed essentially flush with the adajcent or facing edges of the respective flanges 32 and 34. The height or distance between the side edges 45 and 47 of the member 21 is also provided to be only slightly less than the distance between the side edges 65 and 66 so that the letter members, such as the member 21, will appear to be part of the outer lamina 14.

The belt 10 may be prefabricated with the aforementioned structure comprising the inner and outer belt lamina 12 and 14, the support member 26 and the filler strips 62 and 64 secured together in a laminated structure. At the point of sale of the belt 10, the field member 28 may be selected according to its color or design and secured to the surface 29 of the support member 26 in the recess 20. The color and design of the field member 28 facing outwardly from the recess 20 may, of course, be selected according to one's wishes and aesthetic interests.

After application of the field member 28 to the web 30 of the support member 26, the indicia members 21 through 24 or similar members may be selected at will and inserted into the cooperating slots 40 and 42 formed in the respective flanges 32 and 34, as previously described. Once the projections or bosses 44 are disposed in the selected slots 42, the indicia member is snapped into place by forcibly rotating the keys 46 through the slot 40 into the position shown by the solid lines in FIG. 5 whereupon the member 21 is locked into position with the surfaces 50 and 52 engaging the respective surfaces 35 and 37. The members 21 through 24 or any similar member are thus securely retained in the recess 20 unless it is desired to interchange or reposition certain members.

Referring now to FIGS. 7 and 8, there is illustrated another embodiment of the present invention comprising a letter or indicia member, generally designated by the numeral 70 and similar in some respects to the letter member 21 illustrated in FIG. 4. However, the letter member 70 is viewed in FIG. 7 from the opposite or backside to that shown for the letter member 21. The letter member 70 includes a body portion 72, a top side edge 74 and a bottom side edge 76. A plurality of parallel bosses 78 and 80 project from the bottom edge 76 and are of the same general shape, including a beveled edge 81 generally facing the same direction as the backside 71 of the letter member 70. However, the bosses 78 are each also provided with a small nub 82 projecting from the side of the boss opposite the beveled edge 81. The nubs 82 are operable to assist in retaining the letter member 70 on a support member to be described further herein. The letter member 70 is also provided with a plurality of projections or keys 84 extending from the top side 74 of the letter member 70. The keys 84 are provided with cam surfaces 85 and include laterally projecting locking surface portions 86 extending from a face 87 of each of the keys. The keys 84 are formed on a support beam portion 90 which is disposed in a recess 92 formed in the backside 71 of the letter member 70. The support beam 90 is integrally connected to the letter member 70 by an integral flexible hinge portion 94, see FIGS. 8 and 9, wherein the support beam 90 and the keys 84 may be moved relative to the body 72 of the letter member 70.

Figure 10:
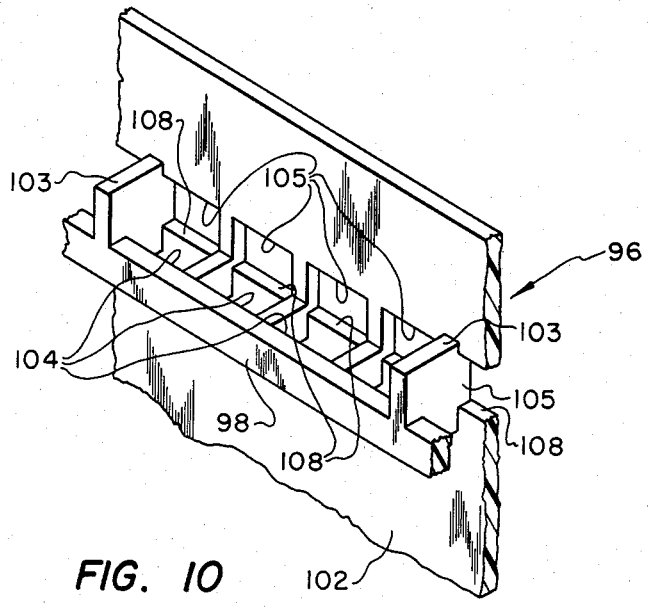
FIG. 10 is a detail perspective view of a portion of one of the letter support members.

As shown in FIGS. 8, 9 and 10 the letter member 70 is adapted to be supported on a support member 96, similar in most respects to the support member 26, and having opposed generally parallel extending flanges 98 and 100 corresponding substantially to the flanges 32 and 34 of the support member 26. The support member 96 includes a web portion 102 forming a base for the flanges 98 and 100. The flanges 98 and 100 may include spaced apart support gussets 103, see FIG. 10 also, and the respective flanges 98 and 100 also include a plurality of spaced apart rectangular cross-section slots or keyways 104 and 106, respectively, and corresponding substantially to the slots 40 and 42 formed in the flanges 32 and 34. The slots 104 and 106 include respective rectangular slot portions 105 and 107 formed in the web 102. The flange 100, the slots 106 and the slot portions 107 are identical to the flange 98, slots 104 and slot portions 105 and are arranged in mirror image to the flange 98 and its associated slots.

Letter members such as the letter member 70 are adapted to be supported on the support member 96 by insertion of the bosses 78 and 80 into respective ones of the slots 106 and by rotating the support beam 90 about its hinge portion 94 to the position shown by the phantom lines in FIG. 8 whereby the key members 84, with the assistance of cam surfaces 85, may be forced into the slots 104–105 and secured therein by engagement of the locking surfaces 86 with a cooperating surface 108 of slot portion 105. The nubs 82 assist in retaining the keys 78 and 80 in the respective associated slots 106 during insertion of the key members 84 into the slots 104. As the letter member 70 is moved from the position indicated by the phantom lines in FIG. 8 to the position indicated by the solid lines the keys 84 are snapped into engagement with the surfaces 108 as the hinge 94 rotates the support beam 90 back into the recess 92. This engagement straightens the hinge 94 and secures the letter member 70 substantially flush against the web 102. The support member 96 may include a separate decorative insert 100 which may be secured to the face 112 of the web 102 to provide a decorative backing or field for the letters supported on the support member.

Referring to FIG. 9, the support member 96 may be incorporated into a name belt 114 similar to the belt 10 and having plural opposed outer layers 116 and 118 enclosing the support member 96 between spaced apart filter strips 117 and 119, respectively. The outer belt layer 118 is provided with an opening 120 for insertion of and removal of letters such as the letter member 70 with respect to the support member 96. Accordingly, the modified letter member construction as described in conjunction with the letter member 70 enjoys all of the benefits of the embodiment described in conjunction with FIGS. 1 through 6 herein except the keys 84 are formed on an integral support beam member 90 whereby all of the keys are rotated in unison during insertion of and removal of the letter 70 with respect to the support member 96. This arrangement facilitates ease of insertion, particularly, of the letter member into its supported position between the flanges 98 and 100 of the support member 96 and the support beam 90 is disposed in a protected recess 92 in the body 72 to minimize the change of unwanted bending or plastic deflection of the support beam prior to installation of the letter member on a support member 96, for example.

The belts 10 and 114 and their component parts may be made from various suitable materials which are aesthetically pleasing and which are possessed of the correct engineering properties to provide a useful article. In accordance with a preferred embodiment of the present invention, the laminae 12, 14, 116 and 118 may be formed of conventional leather belting or suitable synthetic materials. The support members 26 and 96 and the indicia or letter members 21 and 70, for example, may be formed of suitable injection molded plastics such as Nylon or a similar moldable plastic material which has the feel and appearance of leather. The filler strips 62, 64, 117 and 119 may be formed of the same material as the laminae or layers 12, 14, 116 and 118. The field members 28 and 110 may, of course, be formed of several different materials having the proper aesthetic appeal, including plastics and materials having a clothlike appearance. Actual woven or knitted fabric materials may also be used to form the field members 28 and 110.

Figure 11:
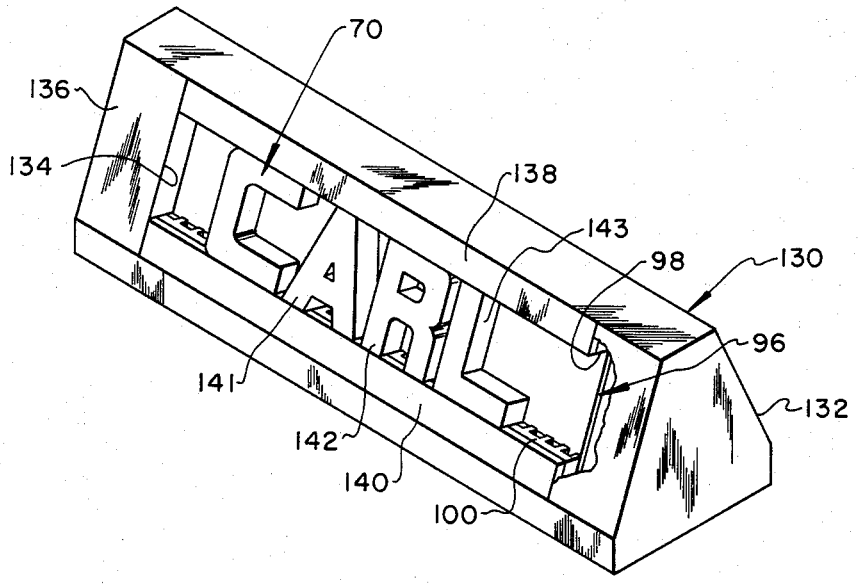
FIG. 11 is a perspective view of a selective letter insert nameplate in accordance with the present invention.

Referring now to FIG. 11, there is illustrated another embodiment of the present invention comprising a sign or nameplate, generally designated by the numeral 130. The sign 130 includes a body member 132 which may be formed of a suitable decorative material such as furniture grade wood or the like and having a generally rectangular recess 134 formed in a face 136. The letter support member 96 is disposed in the recess 134 and suitably secured therein by means not shown. Suitable filler strips 138 and 140 are preferably provided for covering the flanges 98 and 100 in a manner similar to that in which the strips 117, 119 and the lamina 118 cover the flanges of the support member associated with the belt 114. Various letter members such as the letter member 70 and similar letter members 141, 142 and 143, for example, are supported by the support member 96 in the recess 134 to form selected indicia for the sign 130. The letter members 70, 141, 142 and 143 are insertable in engagement with the support member 96 in the same manner as previously described and the process for forming a sign, nameplate or message board using the support member 96 and the letter members is substantially the same as described for providing the name belts 10 or 114.

Although preferred embodiments of the present invention have been described in detail herein those skilled in the art will appreciate that various substitutions and modifications may be made to the specific embodiments described without departing from the scope and spirit of the invention as recited in the appended claims.

What I claim is:

1. A decorative name belt comprising:

an elongated flexible belt member having opposed inner and outer surfaces and including fastening means for securing the belt around a person's waist, said belt member including means forming a recess in said outer surface of said belt member;

support means on said belt member for supporting a plurality of indicia members in said recess at selective spaced intervals to provide decorative indicia on said belt;

at least one indicia member including means cooperable with said support means for securing said one indicia member in said recess in a selected position;

said one indicia member comprises a separate member selectable at will for securement to said support means by cooperating surfaces on said one indicia member and said support means, respectively; and, said support means includes an elongated support member having a web portion disposed between opposed flange means, said flange means each including means defining a pluarality of spaced apart slots formed therein, and said one indicia member includes at least one boss projecting from one side of said indicia member and a key extending from an opposite side of said indicia member, said boss and said key being insertable in selected ones of said slots on respective ones of said flange means for retaining said indicia member on said support member.

2. The belt set forth in claim 1 wherein:

said key includes a portion for hinging said key to said opposite side of said indicia member whereby said key may be bent with respect to said indicia member to provide for inserting said key in a slot in one of said flange means.

3. The belt set forth in claim 2 wherein:

said key includes surface means operable to engage cooperating surfaces on said support member to prevent unwanted removal of said indicia member from said support member.

4. The belt set forth in claim 3 wherein:

said key includes a cam surface engageable with said support member to permit forcible insertion of said key into said slot.

5. The belt set forth in claim 3 wherein:

said one indicia member includes a plurality of keys secured on a support beam integrally formed with said one indicia member and joined to said one indicia member by an integral flexible hinge portion.

6. The belt set forth in claim 5 wherein:

said one indicia member includes a plurality of bosses projecting from said one side, at least one of said bosses including means forming a nub for retaining said one boss engaged with said flange means.

7. The belt set forth in claim 2 wherein:

said flange means comprises opposed elongated flanges each having a plurality of said slots, said slots being adapted to receive a plurality of said indicia members selectively spaced apart on said belt and comprising respective letters of the alphabet to spell a name or the like.

8. The belt set forth in claim 1 including:

a flexible decorative insert member adapted to be supported in said recess behind said one indicia member and forming a decorative field for said one indicia member.

9. The belt set forth in claim 8 wherein:

said web portion of said support member comprises a planar surface for supporting said decorative insert member.

10. The belt set forth in claim 1 wherein:

said belt member comprises at least two lamina of flexible material secured together, one of said lamina of flexible material including an elongated opening therein defining said recess.

11. The belt set forth in claim 10 wherein:

said support member includes opposed web portions extending away from said flange means and disposed between said laminae of flexible material, respectively.

12. A decorative name belt comprising:

an elongated flexible belt member having opposed inner and outer surfaces, said belt member including support means for supporting a pluarlity of indicia members at selective spaced intervals to provide decorative indicia on said belt, and a plurality of indicia members including means cooperable with said support means for securing said indicia members on said belt in preselected positions, said indicia members each comprising a letter of the alphabet selectable at will for securement to said belt by said support means by cooperating interlocking surfaces on said indicia members and said support means, respectively;

said support means includes an elongated support member including opposed flange means, said flange means each including means defining at least one support surface on said flange means and comprising one of said cooperating surfaces, and said indicia members each include at least one boss projecting from one side of said indicia member and a key extending from an opposite side of said indicia member, said boss and said key being cooperable with said support surfaces on said flange means, respectively, for retaining said indicia member on said support member; and, said key includes a portion for hinging said key to said opposite side of said indicia member whereby said key may be bent with respect to said indicia member to provide for movement of said key from a released, non-engaging position to a latched position of interlocking engagement with said cooperating support surface.

13. The belt set forth in claim 12 wherein:

one of said flange means having a slot for receiving said key; and, said key being movable into the slot in said one of said flange means so that said indicia member may be inserted between said flange means in close-fitting relationship between said flange means and opposite side edges of said indicia member, respectively.

14. A letter member for use with a name belt as a man's or woman's furnishing, said belt including a support member for mounting a plurality of letter members spaced apart side-by-side on said belt, said support member comprising means forming a pair of spaced apart opposed flanges, and a web portion between said flanges said flanges and said web portion including respective slot means forming support surfaces for said letter member, said letter member comprising an integral part defining a letter of the alphabet, said part having opposed top and bottom side edges, at least one boss projecting from one of said side edges and at least one key projecting from the other of said side edges of said part, at least one of said boss and said key being hinged to said side edge associated with said one of said boss and said key for inserting said letter member between said flanges with said boss and said key inserted in said slot means, respectively.

15. The letter member set forth in claim 14 wherein:

said key includes a laterally projecting surface formed thereon and engageable with a cooperating support surface on one of said flange means and said web portion for retaining said letter member in a predetermined position on said support means.

16. The letter member set forth in claim 15 wherein:

said key is connected to a side edge of said part by an integral hinge portion.

17. A sign comprising:

an elongated support member including opposed flange means, said flange means each including means forming a plurality of slots, each slot defining at least one support surface on said support member, and at least one indicia member comprising an integral part defining a letter of the alphabet, said part having opposed top and bottom side edges, at least one boss projecting from one of said side edges and at least one key projecting from the other of said side edges of said part, said key being hinged to said side edge associated with said key by an integral hinge portion for inserting said part between said flanges with said boss and said key inserted in said slots in respective ones of said flanges; and said key includes a surface formed thereon and engageable with a support surface on said support member for retaining said part in a predetermined position on said support member.

* * * * *